US007087004B1

(12) United States Patent
Berke

(10) Patent No.: US 7,087,004 B1
(45) Date of Patent: Aug. 8, 2006

(54) SELF-ADMINISTERED BACK MASSAGE

(76) Inventor: Michael N. Berke, 295 Dow Ave., Carle Place, NY (US) 11514

( * ) Notice: Subject to any disclaimer, the term of this patent is extended or adjusted under 35 U.S.C. 154(b) by 1342 days.

(21) Appl. No.: 09/609,166

(22) Filed: Jul. 3, 2000

(51) Int. Cl.
*A63B 21/00* (2006.01)

(52) U.S. Cl. ..... 482/136; 482/132; 482/62; 601/63; 601/94

(58) Field of Classification Search ..... 601/97, 601/115, 116, 118, 112, 124, 125, 128, 131, 601/136, 137, 63, 94, 99, 102; 482/904, 482/91, 132, 136, 148, 38–40, 62; D21/665
See application file for complete search history.

(56) References Cited

U.S. PATENT DOCUMENTS

| | | | | | |
|---|---|---|---|---|---|
| 863,143 | A * | 8/1907 | Bowser | 601/118 |
| 1,257,957 | A * | 2/1918 | Kost | 601/20 |
| 1,560,549 | A * | 11/1925 | Duncan | 601/120 |
| 1,572,794 | A * | 2/1926 | Hamilton | 606/240 |
| 1,872,491 | A * | 8/1932 | Noetzel | 248/231.61 |
| 2,328,156 | A * | 8/1943 | London | 482/132 |
| 2,466,470 | A * | 4/1949 | Norris | 272/57 |
| 2,619,957 | A * | 12/1952 | Hague | 601/122 |
| 2,819,714 | A * | 1/1958 | London | 601/122 |
| 3,120,953 | A * | 2/1964 | London | 482/142 |
| 3,279,463 | A * | 10/1966 | Krimmel | 128/62 |
| 4,176,836 | A * | 12/1979 | Coyle | 482/96 |
| 4,374,519 | A * | 2/1983 | Stauft | 601/128 |
| 4,416,271 | A * | 11/1983 | Chester | 128/57 |
| 4,700,945 | A * | 10/1987 | Rader | 482/132 |
| 5,113,847 | A * | 5/1992 | Holzworth | 128/24 R |
| 5,174,282 | A * | 12/1992 | Bleggi | 128/57 |
| 5,336,152 | A * | 8/1994 | Winslow et al. | 482/132 |
| 5,433,685 | A * | 7/1995 | Winslow et al. | 482/96 |
| 5,669,864 | A * | 9/1997 | Brister | 482/132 |
| 5,774,907 | A * | 7/1998 | Doggwiler | 4/606 |
| 6,056,704 | A * | 5/2000 | Ide | 601/123 |
| 6,468,187 | B1 * | 10/2002 | Boatwright | 482/95 |
| 6,761,672 | B1 * | 7/2004 | Williams | 482/132 |

* cited by examiner

*Primary Examiner*—Lori Amerson
(74) *Attorney, Agent, or Firm*—Myron Amer PC

(57) ABSTRACT

A massaging device which is straddled over the doorstop of a door opening at an elevated location coincident with a hard-to-reach back area and held in place by the leaning weight of a user moving back and forth and up an down permitting a self-administered back massage.

1 Claim, 1 Drawing Sheet

SELF-ADMINISTERED BACK MASSAGE

The present invention relates generally to a massaging device and, more particularly, to the use of a massaging device for the self-administration of a massage to a difficult to reach back areas.

BACKGROUND OF THE INVENTION

Field of Invention

Subluxations of the vertebrae in diverse regions are known to be associated with or occur concomitantly with headaches, neck pain, neck muscle spasms, upper, mid and lower back pain to mention but a few cause and effect circumstances, and understandably has given rise to scientific chiropractic care because of the effectiveness of spinal/structural adjustments of the human body in promoting health where other methods have failed. A masseuse-administered massage is a popular practice. So also is a self-administered massage which is the particular focus of the mode of use of the massaging device of the invention.

An ability to self-administer a massage is already well known in the patented literature. It, of necessity, requires providing a support for a massaging device and thus allowing the user to make massaging contact with the supported device. Examples of supported massaging devices for self-administered massages are U.S. Pat. No. 4,520,798 for "Self Acupressure Method" issued to Lewis on Jun. 4, 1985 and U.S. Pat. No. 5,174,282 for "Massage Apparatus" issued to Bieggi on Dec. 29, 1992, to mention but a few. In the '798 Lewis patent, the massaging device is supported on a wall by brackets interconnected between the wall and the massaging device wherein the brackets are embodied with joints providing degrees of movement to facilitate the positioning of a massaging surface relative to selected back areas of the user receiving the massage.

In the '282 Bieggi patent, the setup is greatly simplified by the suspension of the massaging device from the top edge of a door and the user undergoing body movements while pressing against the suspended massaging device.

While the simplification of the support provided by Bieggi to that of Lewis is noteworthy, it is not entirely satisfactory because the bodily movements of the user, particularly laterally of the massaging surface, urges the device in corresponding lateral movement and when this occurs there is diminished relative movement at the interface of the user's back and the massaging surface and relative movement is, of course, determinative of the effectiveness of the massage being administered.

SUMMARY OF THE INVENTION

Broadly, it is an object of the present invention to provide a supported massaging device contributing to an effective self-administered massage overcoming the foregoing and other shortcomings of the prior art.

More particularly, it is an object to operatively position a massaging device for use in an open doorway and maintain this position stationary during massaging use by using to advantage the leaning pressure applied by the user against the massaging surface, so that maximum relative movement at the critical surface interface of the user and the massage-applying surface occurs, to corresponding maximize the massaging benefit, all as will be better understood as the description proceeds.

BRIEF DESCRIPTION OF THE DRAWINGS

The description of the invention which follows, together with the accompanying drawings should not be construed as limiting the invention to the example shown and described, because those skilled in the art to which this invention appertains will be able to devise other forms thereof within the ambit of the appended claims.

FIGS. 6, 7 and 8 are isolated views of the massaging device used in FIGS. 1–4, in which FIG. 6 is a side elevational view, FIG. 7 is a front view and FIG. 8 a rear view.

DESCRIPTION OF THE PREFERRED EMBODIMENT

Figures 1, 2, 3, 4:
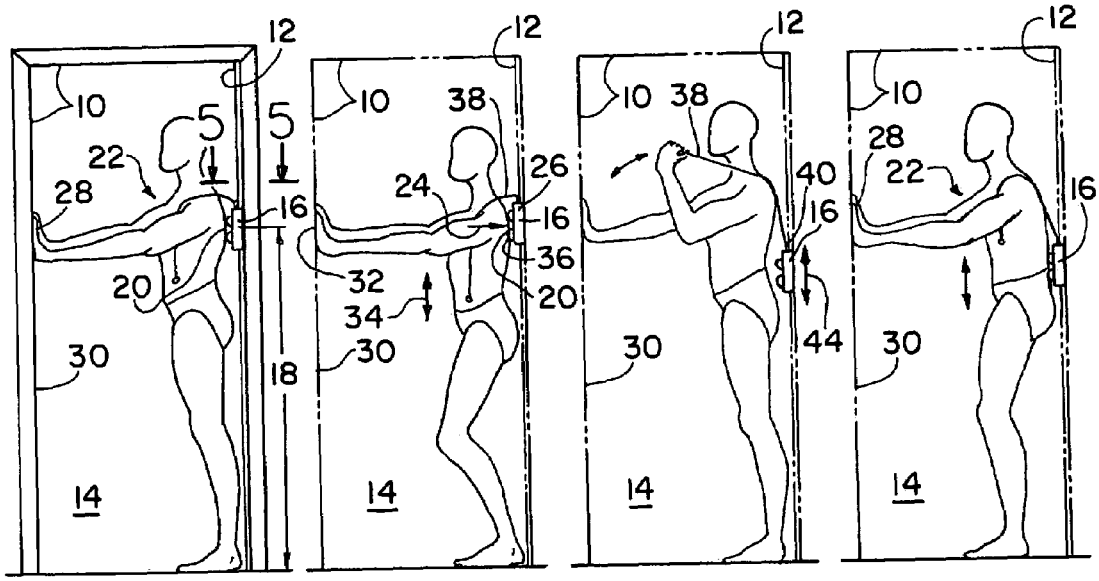
FIG. 1 is a side elevational view of a massaging device according to the present invention in use in a doorway in its operative position on a doorway doorstop and held in place by the leaning weight of a user.
FIGS. 2, 3 and 4 are views similar to FIG. 1, in which the doorway is simplified in a phantom perspective, and the figures illustrate modes of use.
Figure 9:
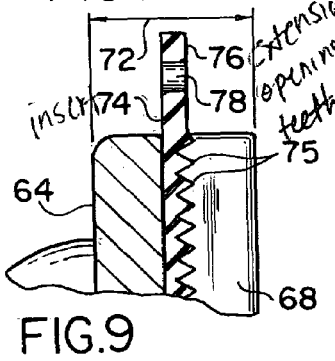
FIG. 9 is a partial cross sectional view projected from FIG. 5 and as seen along line 9–9 of FIG. 8.

Back massaging devices are already well known as exemplified by the prior patents previously noted and are of various constructions. However, not known and underlying the present invention, is the recognition that an open doorway 10 having a vertically oriented doorstop 12 can advantageously be used as the site 14 of the massage, and the massaging device 16 held in place on the doorstop 12 at a desired elevation 18 coinciding with the region 20 of the back of the user 22 receiving the massage and, most significant, wherein the massaging device is held in place at said elevation 18 by the force 24 applied by the leaning in the direction of the force by the user against the massaging device 16. That is, the massaging device 16 appropriately constructed as will be subsequently described to have a back-massaging function, is positioned by the user 22 reaching back and placing the device 16 in straddling relation, as at 26, again as will be subsequently explained, to the doorstop 12, and leaning against the massaging device 16. Next, bracing himself with his hands 28 against the opposite door jamb or frame 30, as at 32, possibly even increasing the leaning force 24, the user with knee flexuring will move up and down in opposite directions 34 to correspondingly move the back region 20 being massaged up and down over the stationarily held massaging device 16 at the elevation 18, thus achieving a massaging function at the interface of the massaging device 16 and the back region 20, as at 36.

To change to a lower region for massaging, a cord 38 attached at one end 40 to the massaging device 16 is used to lower and subsequently to raise, the device 16, in the opposite directions 44, as required in the massaging routine.

Figure 5:
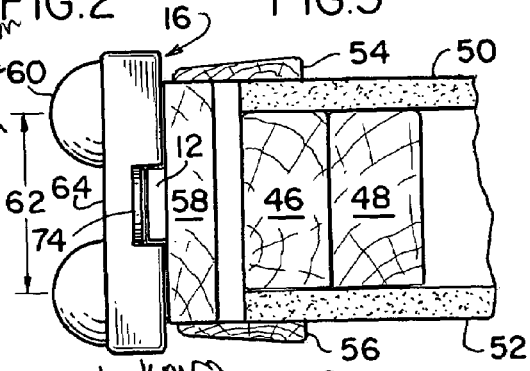
FIG. 5 is a plan view in cross section taken along line 5–5 of FIG. 1 which illustrates a typical construction of a doorway and of the doorstop thereof.
Figure 7:
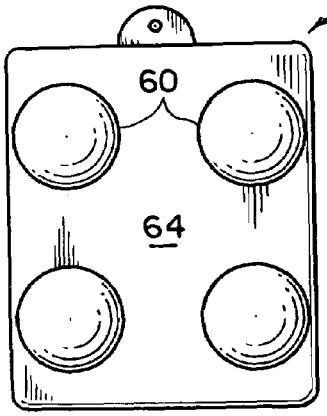
Figure 6:
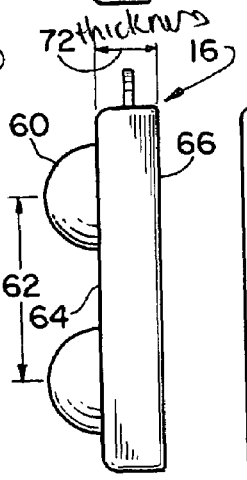
Figure 8:
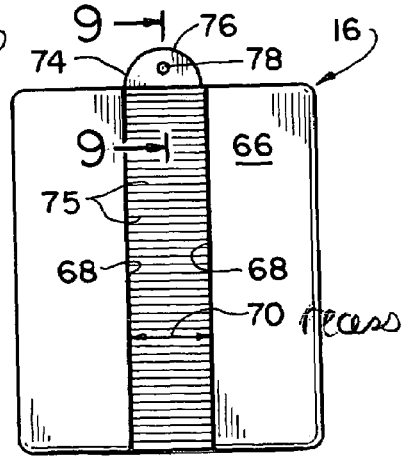

For completeness sake it is noted in conjunction with FIG. 5 that typically the construction of a doorway 10 embodied with a doorstop 12 includes connected studs 46 and 48 assembled between sheet rock panels 50 and 52, and cooperating clam shell moldings 54 and 56 appropriately attached to extend forwardly of the sheet rock panels 50 and 52 for appropriate attachment on opposite sides to a door-frame member 58. Mounted vertically and centrally at the inner surface of the doorframe 58 is the doorstop 12 which typically is provided in the standard size of 1¼ inch wide and ⅜ inch thick.

As best shown in detail in FIGS. 6–9, and also in FIG. 5, a preferred embodiment of the massaging device 16 is rectangular in shape, being 5 inches by 6 inches, providing a massaging function with semi-circular projections, 4 in number, individually and collectively designated 60, the centers of which are spaced 3 inches apart, as at 62, and extending forwardly of the device front surface 64. On the device rear surface 66, spaced apart walls 68 bound a recess 70 sized to straddle the 1¼ inch width of the doorstop 12 and of an appropriate depth into the thickness 72 of the device 16 which in practice provided good results at 1 inch.

The preferred construction material of the body of the massaging device 16 is plastic and includes a construction material of a hard rubber for an insert 74 with molded teeth 75 positioned and adhesively secured in place in the recess 70 which optionally can be used to hold the device 16 against sliding movement when the user's torso, as previously described, moves up and down in the opposite directions 34. Insert 74 is made with an extension 76 which has opening 78 for the attachment of the string 38.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A self-administered back massage method practiced in a transverse plane of a doorway and applied to an individual by leaning contact against a semi-spherical configured massaging device, an improvement consisting of a method of facilitating and establishing said leaning contact between said massaging device and a selected back area of said individual is oriented transversely to the plane of the doorway thereby increasing the massaging pressure applied at the interface of the device and the selected area of the individual, said method comprising the steps of:

a) providing a positioning site for a back massage device, said site including a door frame having two opposite side walls bounding there between a vertical plane of a doorway opening and including a door stop, b) providing a massaging device comprising a base having a front and rear surface, a plurality of semi-spherical projections extending from a front surface of said base, a vertical notch in said base rear surface consisting of a cooperating pair of side walls bounding a positioning recess there between, c) positioning said massaging device in a transverse relation to a vertically oriented rectangular strip disposed flat against said one side wall of said door frame and having projected in said positioning recess a vertical strip normally serving as a stop for a pivotal traverse of a door mounted in said doorway opening plane limiting said massaging device to linear tracking movement along said door stop vertical strip and prohibited by abutment of said recess side walls against said door stop vertical strip from partaking of movement in transverse relation to said linear tracking, d) positioning an individual in said plane of said doorway, e) establishing leaning engagement of an individual against said positioned massaging device as outlined in step (c), f) instructing an individual to supplement said established leaning engagement by pushing against the opposite side wall of said doorway to cause linear movement of the individual in the direction of said massaging device, whereby said linear movement contributes to adjusting the position of said massaging device to a back area of a user and said absence of said transverse movement as might result from transverse bodily movements while maintaining said engagement without slippage at an interface of said semi-spherical configurations of said massage device with a back area of a user contributes to maximizing the self-administered massaging service of said massaging device.

* * * * *